US008387172B2

(12) United States Patent
Nasrallah

(10) Patent No.: US 8,387,172 B2
(45) Date of Patent: Mar. 5, 2013

(54) WATER FLOW CONTROLLING SYSTEM AND METHOD

(75) Inventor: Jeffrey Nasrallah, Honolulu, HI (US)

(73) Assignee: Prodius LLC, Honolulu, HI (US)

( * ) Notice: Subject to any disclaimer, the term of this patent is extended or adjusted under 35 U.S.C. 154(b) by 662 days.

(21) Appl. No.: 12/614,273

(22) Filed: Nov. 6, 2009

(65) Prior Publication Data

US 2011/0107506 A1 May 12, 2011

(51) Int. Cl.
*E03D 1/14* (2006.01)

(52) U.S. Cl. ..... 4/324; 4/415

(58) Field of Classification Search ..... 4/415, 324, 4/325, 313, 302, 305, 406
See application file for complete search history.

(56) References Cited

U.S. PATENT DOCUMENTS

| | | | | |
|---|---|---|---|---|
| 342,495 | A | | 5/1886 | Barker |
| 2,056,087 | A | | 9/1936 | Andrews |
| 3,108,286 | A | | 10/1963 | Moore |
| 3,334,359 | A | | 8/1967 | Weingartner |
| 4,014,050 | A | | 3/1977 | Goldsworthy |
| 4,058,858 | A | | 11/1977 | Che-Wei |
| 4,175,296 | A | | 11/1979 | Goldman |
| 4,224,703 | A | | 9/1980 | Makhobey |
| 4,225,986 | A | | 10/1980 | Mauk |
| 4,225,987 | A | | 10/1980 | Goldman et al. |
| 4,391,003 | A | | 7/1983 | Talerico et al. |
| 4,392,260 | A | | 7/1983 | Bensen |
| 4,428,084 | A | | 1/1984 | Joun |
| 4,447,919 | A | | 5/1984 | Mobilia |
| 4,469,197 | A | * | 9/1984 | Ishida ..... 185/45 |
| 4,536,900 | A | | 8/1985 | Hayes |
| 4,651,359 | A | | 3/1987 | Battle |
| 4,881,279 | A | | 11/1989 | Harney |
| 5,187,818 | A | | 2/1993 | Barrett, Sr. |
| 5,228,146 | A | | 7/1993 | Martell |
| 5,319,808 | A | | 6/1994 | Bishop et al. |
| 5,432,959 | A | | 7/1995 | Ellsworth |
| 5,469,585 | A | | 11/1995 | Shiue |
| 5,524,297 | A | | 6/1996 | Harrison |
| 5,647,067 | A | | 7/1997 | Boyle |
| 5,819,329 | A | | 10/1998 | Dooney |
| 6,795,982 | B2 | | 9/2004 | Noboru |
| 7,028,347 | B2 | | 4/2006 | Sanderson |
| 7,200,877 | B2 | | 4/2007 | Peng |

(Continued)

OTHER PUBLICATIONS

Brondell PerfectFlush product release, Popular Science, circa May 2009.

*Primary Examiner* — Gregory Huson
*Assistant Examiner* — Christine Skubinna
(74) *Attorney, Agent, or Firm* — Leighton K. Chong

(57) ABSTRACT

A system for controlling the duration and volume of a flow of water in a flush of a Toilet, which includes a buoyant flush valve which is non-automated in user actuation thereof to a raised open position. The system includes a converting element, for converting the buoyant flush valve to a non-buoyant flush valve which is non-automated in user actuation thereof to a raised open position. A programming element enables programming of a controlling time, for controlling the duration and volume of flow of water in a flush of a toilet. A controlling element is connected to the programming element and the non-buoyant flush valve, for retaining the non-buoyant flush valve in a raised open position upon non-automated user actuation thereof to the raised open position, and for releasing the non-buoyant flush valve from the raised open position for closing the non-buoyant flush valve, within the controlling time.

13 Claims, 15 Drawing Sheets

U.S. PATENT DOCUMENTS

| | | | | |
|---|---|---|---|---|
| 7,225,478 | B2 | 6/2007 | Lim | |
| 7,293,583 | B2 | 11/2007 | Arigoni | |
| 7,415,737 | B2 | 8/2008 | Hung | |
| 2005/0229298 | A1 | 10/2005 | Bayer | |
| 2007/0079432 | A1 | 4/2007 | Shoikhet et al. | |
| 2008/0053532 | A1 | 3/2008 | Miller et al. | |
| 2009/0126094 | A1 | 5/2009 | Laube | |
| 2010/0050331 | A1* | 3/2010 | Sim | 4/324 |
| 2010/0263116 | A1* | 10/2010 | Pinizzotto et al. | 4/324 |

* cited by examiner

FIG. 6
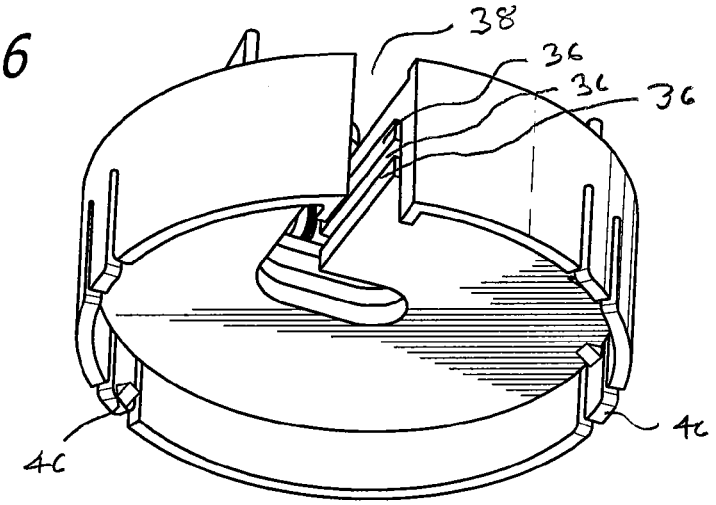
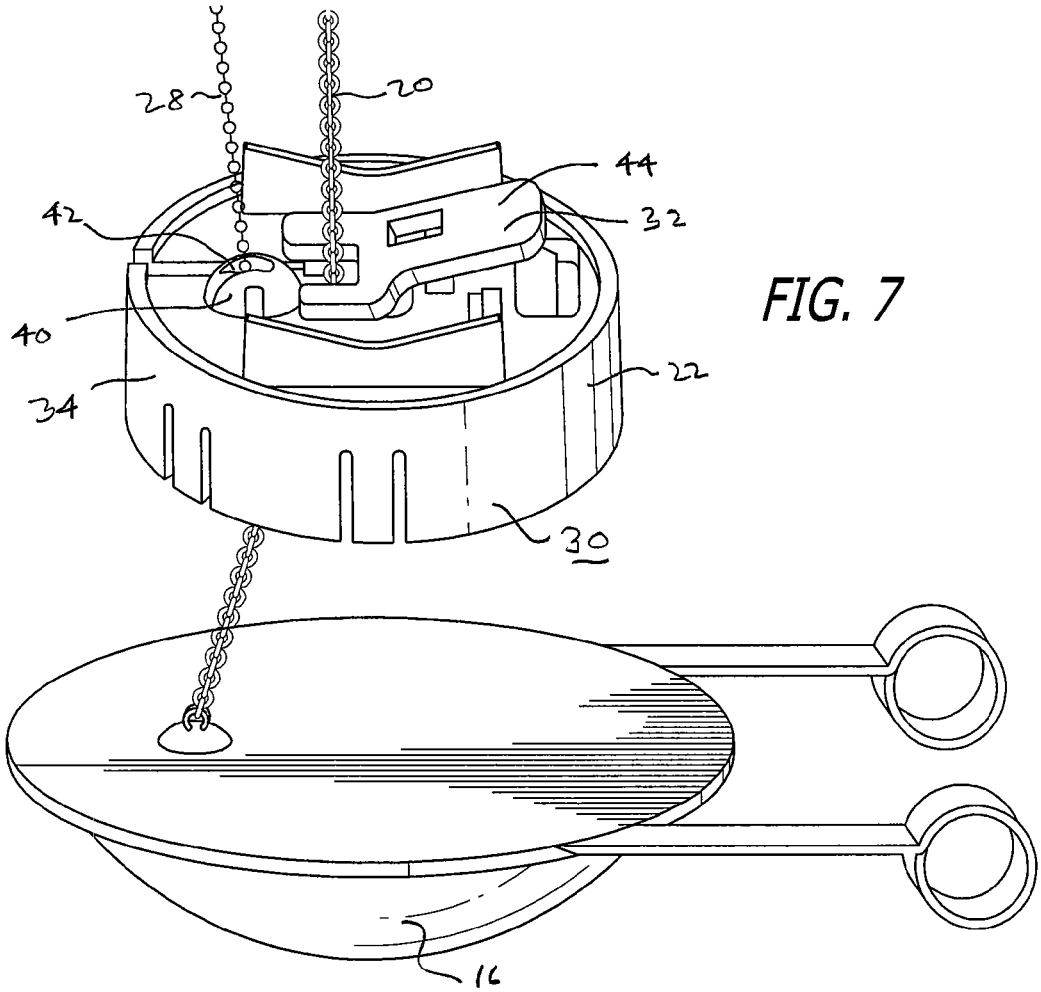
FIG. 7

FIG. 18
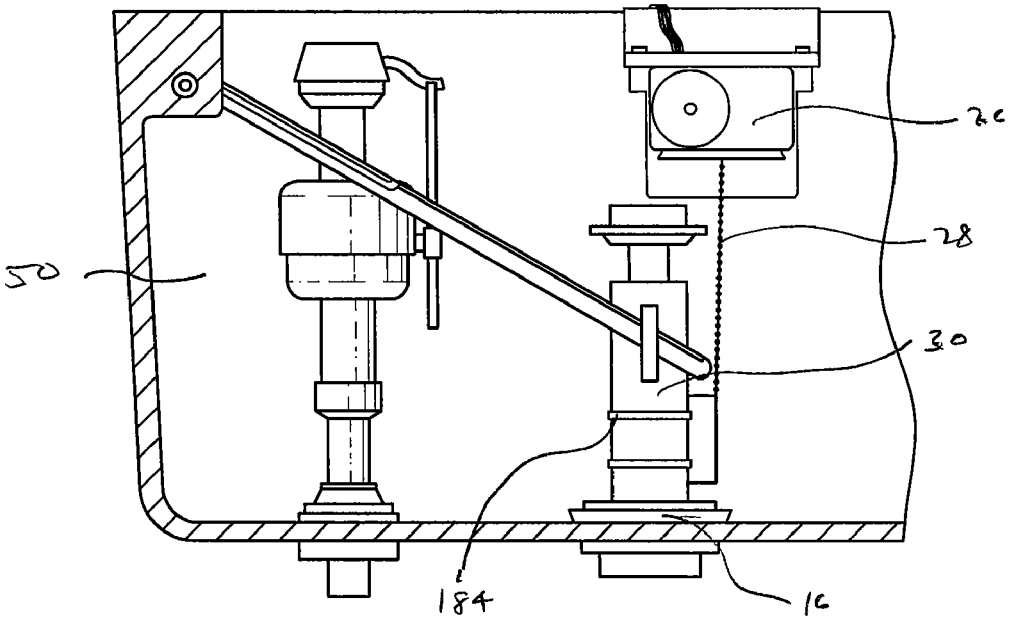
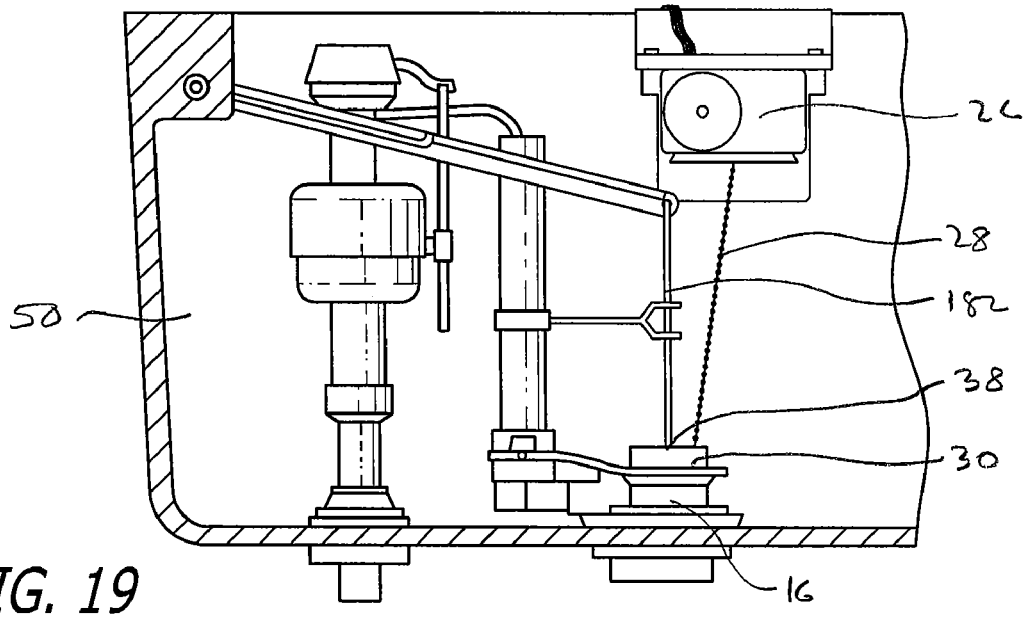
FIG. 19

WATER FLOW CONTROLLING SYSTEM AND METHOD

COPYRIGHTABLE SUBJECT MATTER

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention is generally related to water flow control systems, and more particularly, to a system and method for controlling the flow of water in a flush of a toilet.

2. General Background and State of the Art

Water flow systems include flush toilets, each of which includes a toilet tank, wherein a flush is created by a flush valve that opens and closes to release water from the tank to the bowl to create a flush. Flush valves are buoyant. Therefore, when a toilet is flushed, the flush valve floats and remains open for a fixed amount of time, until the water in the tank lowers to the point where the buoyant flush valve can no longer float, at which time the flush valve closes.

The most common toilet currently found in the home is a gravity flush tank type toilet. A tank style toilet includes a tank and a toilet bowl. The tank is initially filled through a fill valve. A buoyant flush valve is mounted in the bottom of the tank, which releases the water in the toilet tank to flush the toilet bowl. In addition, a siphon is molded into the bowl. As water enters the bowl, the extra water spills over the edge of the siphon tube and drains away into the sewer pipe. Water enters the bowl at a fast rate, causing the siphon tube to fill, whereupon the siphon flushes the fluid and any waste out of the bowl into the sewer pipe. The bowl is emptied, air enters the siphon tube, and the siphoning process stops. The toilet tank operates to supply a volume of water to the bowl at a sufficient rate to activate the siphon.

The flush valve is mounted in an opening and controls water flow between the tank and the bowl. The flush valve includes a valve seat and a flap lid. Most flush valves operate with a flap lid, also known as a flapper.

There are four common types of flush valves: a flap lid type, an actuator type, a cylinder type, which is also known as a Certain Flush valve or Mansfield valve, and a lift wire type. These four flush valve types, though appearing different in size and shape, all include a flush valve that floats in the open position.

A dual flush toilet has two different flush options for water conservation, a smaller water volume which is used for flushing liquid waste, and a larger water volume which is used for flushing solid waste. Currently, dual flush retrofit kits, for enabling two different flush cycles, have two different flush valves which open and close where water can exit, and two different flush levers, so that the user can select a large flush or a small flush. They require changing the flush lever and flush valve of an existing toilet. Installation of these dual flush retrofit kits typically requires disassembling the entire toilet, so that the flush valve and flush handle can be replaced.

Dual flush toilet specifications outlined by the Environmental Protection Agency for water conservation call for dual flush toilets to use less than a gallon (three liters) of water to flush liquid waste, and approximately one-point-six gallons (six liters) to flush solid waste, which equates to an effective flush volume of one-point-two-eight gallons.

The U.S. Congress mandated that all toilets sold in the U.S. as of Jan. 1, 1994 be Ultra-Low-Flush Toilets (ULFTs) having a maximum average flush volume not exceeding one-point-six gallons (six liters) per flush. The ULFTs are significantly more water efficient then the older toilets which used three-point-five, five, and seven gallons of water per flush.

When a dual flush retrofit kit is used with a ULFT toilet, it increases the amount of water used during a large flush. In particular, many ULFTs use a high water capacity tank, which holds three-point-five gallons, but use an early-closing flapper to achieve a one-point-six gallon flush volume. An early closing flapper has a reduced buoyancy which causes the flapper to close the flush valve before the tank is entirely evacuated of water. As a result, only a fraction of the water in the tank of ULFTs flows through the flush valve to the bowl before the flush valve closes. When a dual flush retrofit kits is installed in a ULFT that uses an early closing flapper, the result is that all three-point-five gallons of water in the tank are used during the full flush cycle. ULFTs are designed to only use one-point-six gallons per flush. However, water consumption can increase to three-point-five gallons per flush during the full flush cycle with dual flush retrofit kit.

Therefore, there has been identified a continuing need to provide system and methods for controlling the flow of water during the flushing of a toilet, to conserve water.

INVENTION SUMMARY

Briefly, and in general terms, in accordance with aspects of the invention, and in a preferred embodiment, by way of example, there is provided a system for controlling the duration and volume of a flow of water in a flush of a toilet, wherein the toilet includes a buoyant flush valve which is non-automated in user actuation thereof to a raised open position. The system includes a converting element, for converting the buoyant flush valve to a non-buoyant flush valve which is non-automated in user actuation thereof to a raised open position. It also includes a programming element, for enabling programming of a controlling time, for controlling the duration and volume of flow of water in a flush of a toilet.

The system also includes a controlling element, connected to the programming element and the non-buoyant flush valve, for retaining the non-buoyant flush valve in a raised open position upon non-automated user actuation of the non-buoyant flush valve to the raised open position, and for releasing the non-buoyant flush valve from the raised open position for closing the non-buoyant flush valve, within the controlling time.

In accordance with other aspects of the invention, there is further provided a system wherein a toilet includes a flush actuator, which is connected to the non-buoyant flush valve, and wherein user actuation of the flush actuator generates non-automated user actuation of the non-buoyant flush valve to the raised open position.

In accordance with other aspects of the invention, the converting element comprises a weighted element, able to be connected to the buoyant flush valve, and a connecting element, for connecting the weighted element to the buoyant flush valve.

In accordance with another aspect of the invention, the programming element is programmable for two controlling times. The two controlling times comprise a small flush time and a large flush time. The small flush time comprises a controlling default flush time. The system is programmable to enable user actuation of the large flush time.

In still further aspects of the invention, the programming element comprises a user interface module, includes a processor, and is programmable for a time within the period of the minimum time required to complete a flush of the toilet to the maximum time required to drain all of the water from a toilet tank. It is positionable at a user-accessible location.

In still further aspects of the invention, the controlling element comprises a control module, which is connected to the programming element and the non-buoyant flush valve. The control module retains the non-buoyant flush valve in the raised open position, and releases the non-buoyant flush valve from the raised open position for closing the non-buoyant flush valve, within the controlling time. The controlling element further includes a connecting element, connected at one end to the controlling element and at the other end to the non-buoyant flush valve. The controlling element includes electro-mechanical elements.

In accordance with further aspects of the invention, the system is able to be used in conjunction with a flush valve already in a toilet, including any of the common types of flush valves currently in use. It does not require replacement of the toilet flush valve.

In another aspect of the invention, the system is retrofittable in a standard toilet tank with a standard toilet tank lid. The controlling sub-system is able to be suspended inside the standard toilet tank, and the programming sub-system is positionable at a user-accessible location, for functionality and aesthetic appeal. The system does not require replacement of any of the wide variety of sizes and shapes of standard toilet tanks and standard toilet tank lids, is not stored inside a specialized toilet tank lid, and does not require specialized tools for installation.

In accordance with another aspect of the invention, the system is able to be installed in a toilet, without converting non-automated actuation of the flush handle to an automated process. Also, the flush valve does not need to be replaced, and the toilet does not need to be disassembled for installation of the system.

In a further aspect of the invention, the system is battery operated, eliminating the need for a potentially dangerous wall outlet plug, and operates efficiently to provide long life and functionality for the batteries.

In still other aspects of the invention, the system enables the connection of a connecting element to the toilet flush chain without the need for disconnecting the flush chain from the flush lever or the flush valve.

In still another aspect of the invention, the system includes thin mounting brackets which mount to all types of lip overhangs of toilet tanks regardless of the thickness or shape of the lip of the tank.

In other aspects of the invention, the programming element comprises a user interface module, and the user interface module includes a sensing element, for sensing the presence of a person and the length of time the person has been using the toilet, and for automatically determining whether to provide a small flush time or a large flush time. The sensing element also includes a time threshold determining element for enabling the user to program a time threshold for the sensing element to determine the type of flush to provide.

These and other aspects and advantages of the invention will become apparent from the following detailed description and the accompanying drawings, which illustrate by way of example the features of the invention.

BRIEF DESCRIPTION OF THE DRAWINGS

FIG. 6 is an underside perspective view of a converting element in the present invention;

FIG. 7 is a partially expanded perspective view of a converting element and connecting elements, and a flapper valve, in the present invention;

FIG. 18 is cutaway side elevational partly fragmentary view of a toilet which includes a controlling system and a converting element of the present invention for a Mansfield type flush valve system;

FIG. 19 is cutaway side elevational partly fragmentary view of a toilet which includes a controlling system and a converting element of the present invention for a Lift Wire type flush valve system;

DETAILED DESCRIPTION OF THE PREFERRED EMBODIMENTS

Figure 1:
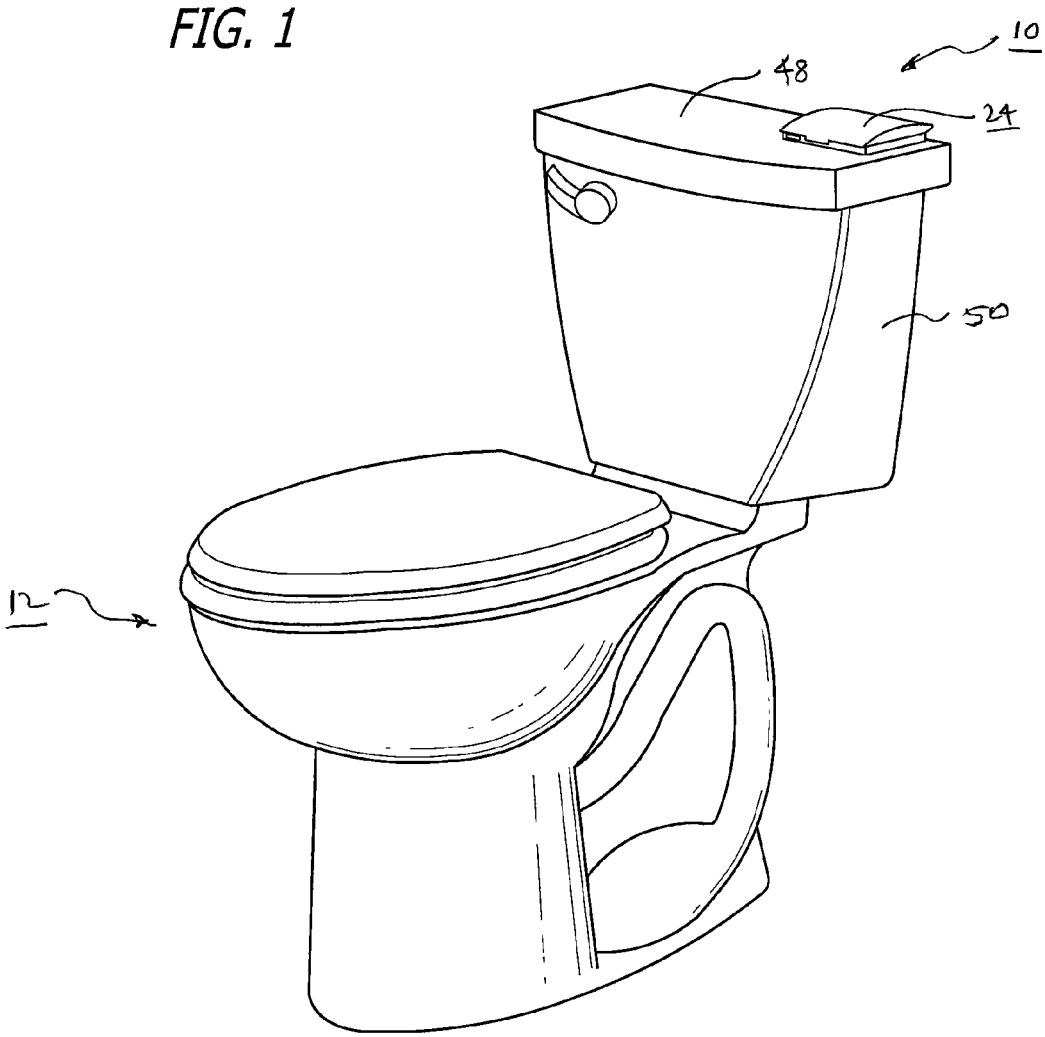
FIG. 1 is a perspective view of a toilet which includes a programming element of the present invention.

The system according to the invention comprises a control system 10, for controlling the duration and volume of flow of water in a flush of a toilet 12. It constitutes a programmable multiple flush conversion kit for gravity flush toilets, that provides multiple distinct flush options where the exact volume of water used for each of the multiple options is programmable. The system 10 controls the way the common home toilet 12 works by altering the way a flush valve 14 works, to enable multiple separate flush operations where each flush uses a pre-set amount of water per flush. It is operable on all gravity flush toilets 12, and with all types of buoyant flush valves 14, which operate on the principal of water passing beneath a buoyant flush valve 14 via gravity force.

The control system 10 constitutes a programmable flush valve control system, which enables control of the operation of the flush valve 14 such that the flush valve 14 is no longer buoyant, and the duration of the flush no longer depends on the flush valve 14 losing buoyancy in order to close. By converting the flush valve 14 to a non-buoyant flush valve 16, the control system 10 enables the non-buoyant flush valve 16 to be closed at any programmed time, thus controlling the duration of the flush and the volume of flow of water used.

The toilet 12 includes a flush actuator 18, and a flush actuator connecting element 20 for connecting the flush actuator 18 to the non-buoyant flush valve 16. User actuation of the flush actuator 18 generates non-automated user actuation of the non-buoyant flush valve 16 to the raised open position. The flush actuator connecting element 20 may comprise a chain, metal chain links, plastic chain links, rubber straps, metal ball-bead chains, plastic ball-bead chain, lift wire, or the like.

Referring in the drawings to FIGS. 1-20, in which like reference numerals refer to corresponding components, the control system 10, according to the invention, enables control of the duration and volume of flow of water in a flush of a toilet 12. In FIG. 2, a toilet 12 is shown which includes a buoyant flapper type flush valve 14 which is non-automated in user actuation thereof to a raised open position.

Figure 3:
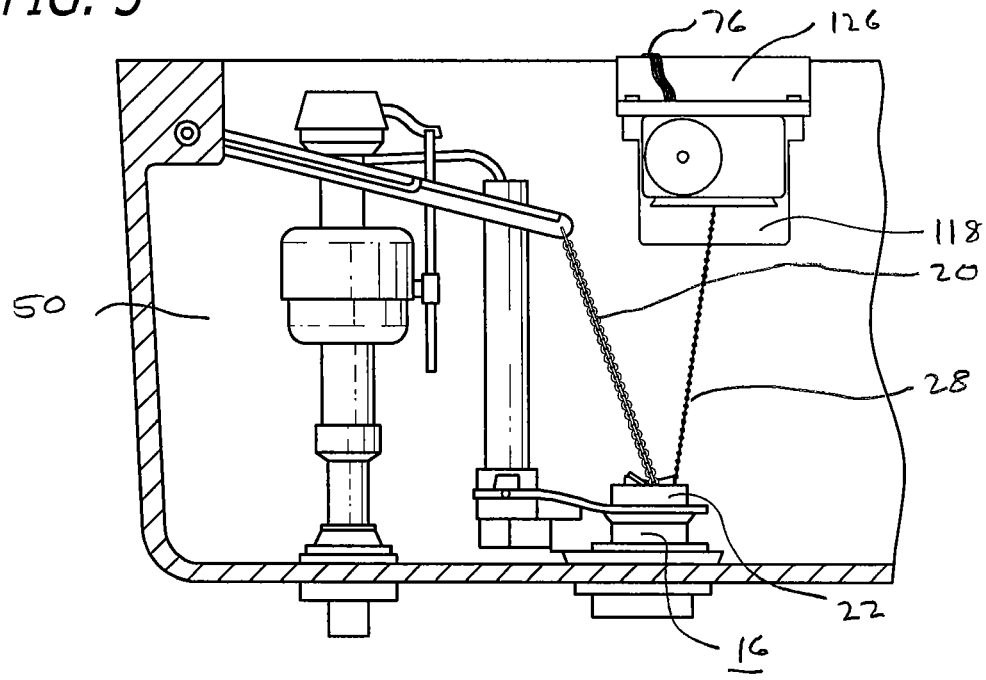
FIG. 3 is cutaway side elevational partly fragmentary view of a toilet which includes a controlling system and a converting element in the present invention for a Flapper Valve type flush valve system.

As illustrated in FIGS. 3 and 6-7, the control system 10 includes a converting element 22, for converting the buoyant flush valve 14 to a non-buoyant flush valve 16 which is non-automated in user actuation thereof to a raised open position. It further includes a programming element 24, for enabling programming of a controlling time, for controlling the duration and volume of flow of water in a flush of the toilet 12. A controlling element 26 comprising a control module in the system is connected by a flat ribbon cable 76 to the programming element 24. The controlling element 26 is further connected by a control module connecting element 28 to the converting element 22 which connects to the non-buoyant flush valve 16. The control module controlling element 28 retains the non-buoyant flush valve 16 in the raised open position upon non-automated user actuation thereof to the raised open position, and releases the non-buoyant flush valve 16 from the raised open position for closing the non-buoyant flush valve, within the controlling time.

The converting element 22 comprises a weighted element 30, able to be connected to the buoyant flush valve 14 or the flush actuator connecting element 20, and a weighted element connecting element 32, for connecting the weighted element 30 to the buoyant flush valve 14 or the flush actuator connecting element 20.

The weighted element 30 includes a housing 34, weights 36 positionable in the housing 34, and a main channel 38 for insertion therethrough of the flush actuator connecting element 20, The weighted element 30 and provides an anchoring point 40 for attachment and locking thereto of the control module connecting element 20, which anchoring point 40 further includes an opening 42 for extension of the control module connecting element 20 thereinto. The weighted element 30 further includes a clamping element 44, for enabling clamping thereto of the flush actuator connecting element 20. Alternatively, the weighted element 30 may comprise a solid weight which includes a slot, for insertion therethrough of the flush actuator connecting element 20, and which provides an anchoring point for attachment and locking thereto of the control module connecting element 28.

The weights 36 in the housing 34 of the weighted element 30 may comprise weight disks, and the housing 34 for example may hold up to five weight disks available for a total weight of about six ounces. Flush valves that are more buoyant may require most if not all of the weight disks for non-buoyancy. Flush valves that require more weight can have weight disks added, up to the maximum available, while flush valves that require less weight can have weight disks removed. Finger members 46 positioned beneath the bottom weight disk are able to lock the weight disks in place and prevent them from coming out.

The clamping element comprises a spring-loaded tab 44, for enabling securing thereby of the converting element 22 to the flush actuator connecting element 20. The spring-loaded tab 44 enables the weighted element 30 to slide downward on the flush actuator connecting element 20, for positioning thereof, but does not allow the weighted element 30 to be pulled back up without pressing down to unlock the spring-loaded tab 44. Preferably, the weighted element 30 is secured and locked into place directly above the non-buoyant flush valve 16. This arrangement for connecting the weighted element 30 is usable for connecting to flapper type flush valves and lift wire type flush valves.

The control module connecting element 28 may comprise a chain, metal chain links, plastic chain links, rubber straps, metal ball-bead chains, plastic ball-bead chain, lift wire, monofilament, string, or the like.

A weighted element 30 is able to be attached to flush valves such as the flapper type flush valve herein, and to an actuator type flush valve, a lift wire type valve, a tower type flush valve, and the like.

Figure 2:
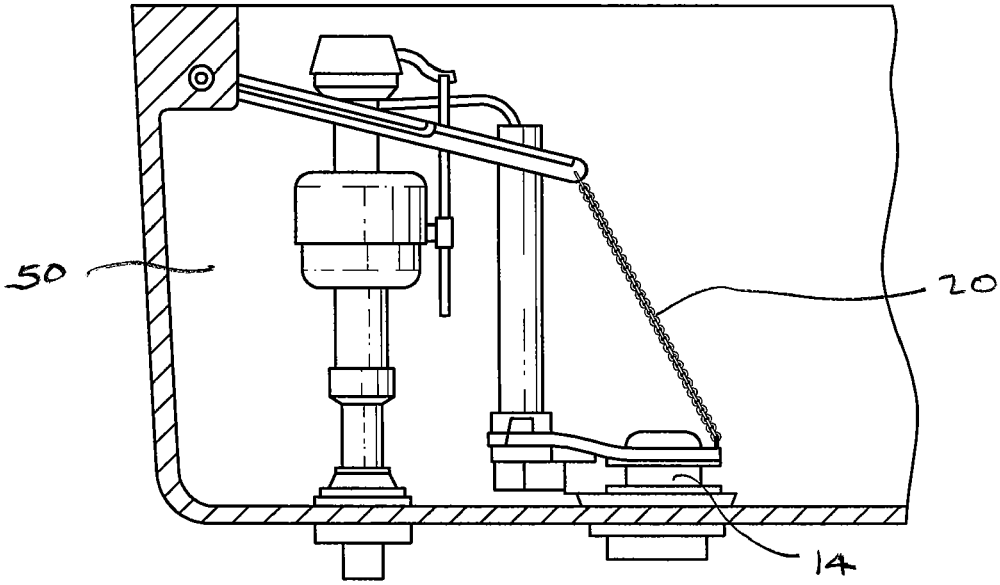
FIG. 2 is a cutaway side elevational partly fragmentary view of a toilet and which does not include a controlling element and a converting element of the present invention for a Flapper Valve type flush valve system.
Figure 4A:
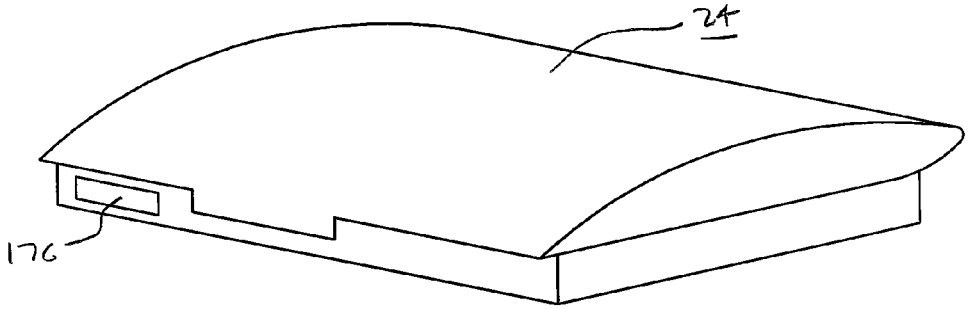
FIG. 4A is a perspective view of a programming element with the cover closed including a sensing element in the present invention.
Figure 4B:
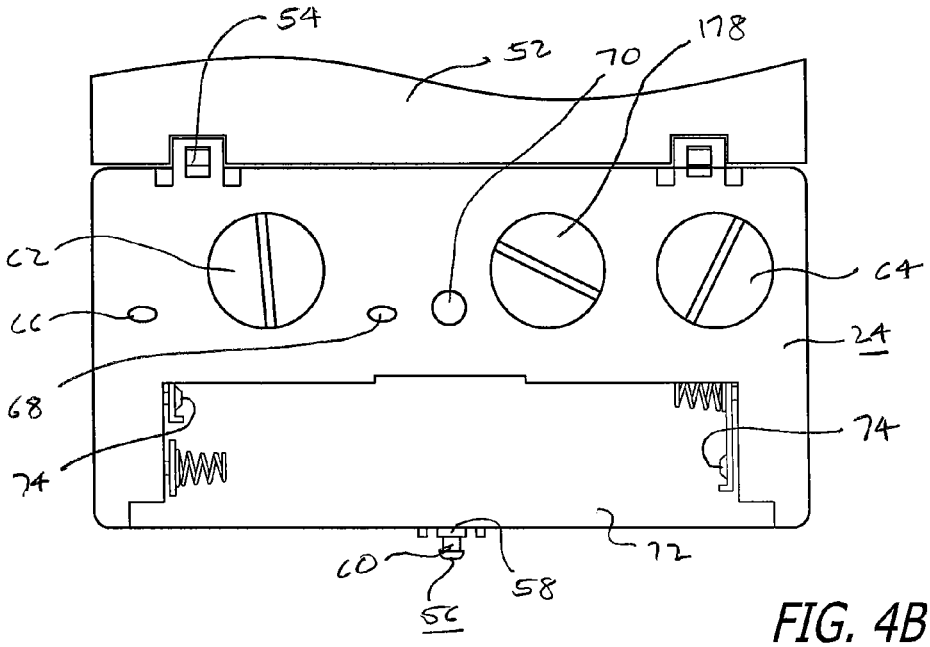
FIG. 4B is a perspective view of a programming element with the cover open in the present invention.
Figure 5:
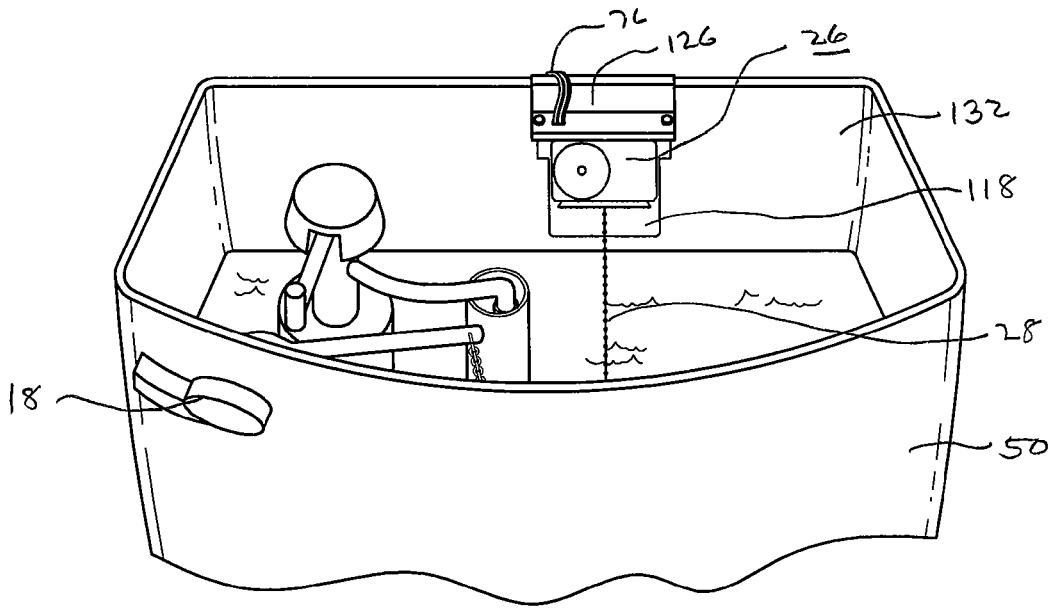
FIG. 5 is a perspective view of a controlling element in a toilet tank with the lid off in the present invention.
Figure 8:
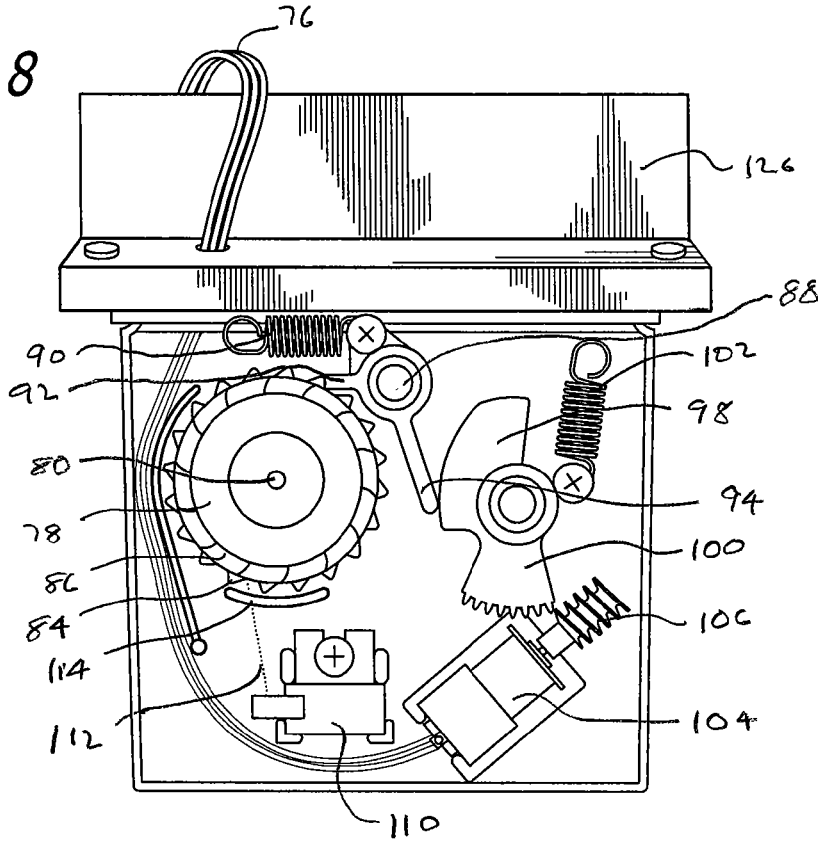
FIG. 8 is an elevational view of a housing and the interior components of a controlling element, in a retained position for a non-buoyant flush valve, in the present invention.
Figure 9:
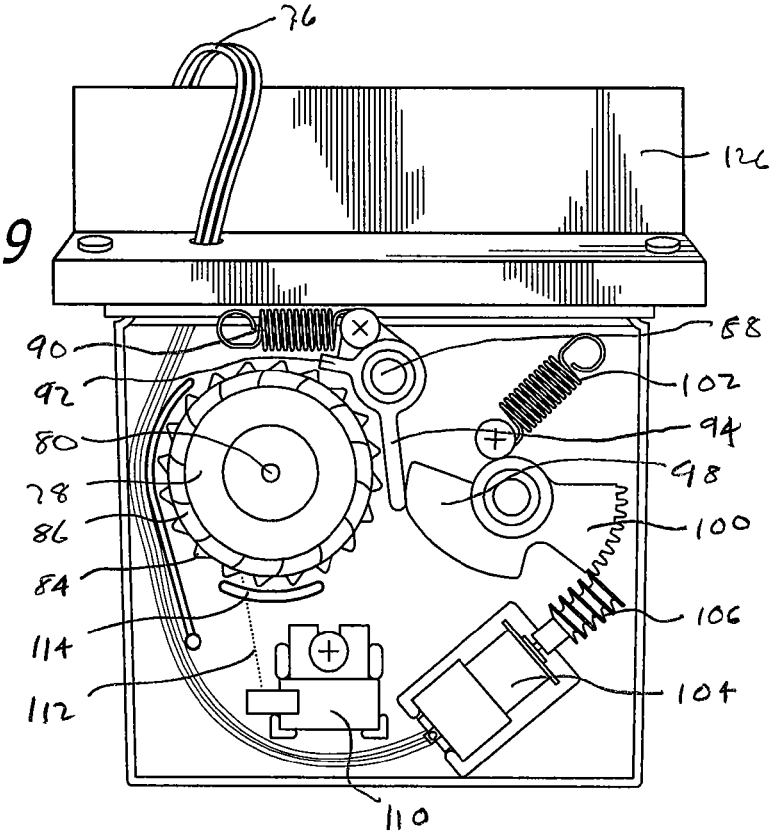
FIG. 9 is an elevational view of a housing and the interior components of a controlling element, in a released position for a non-buoyant flush valve, in the present invention.
Figure 10:
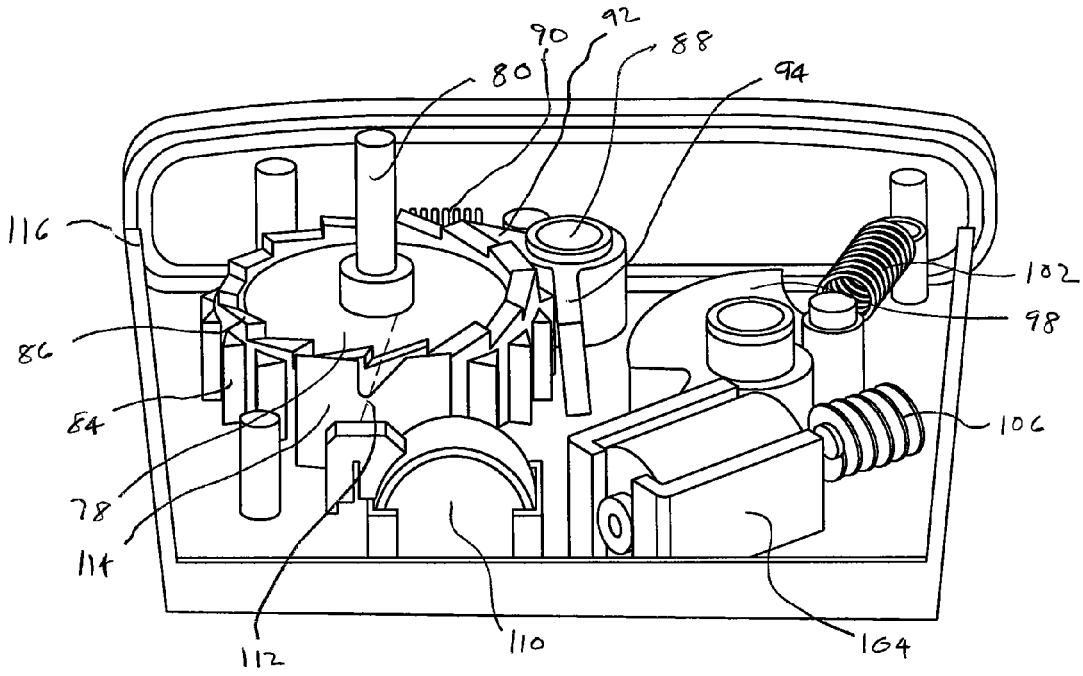
FIG. 10 is a perspective view of the interior components of a controlling element in the present invention.
Figure 11:
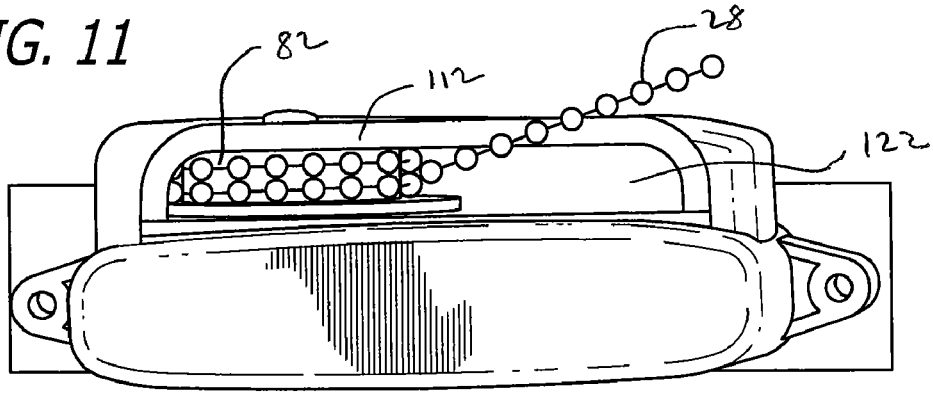
FIG. 11 is a perspective view of the interior components of a controlling element in the present invention.
Figure 12:
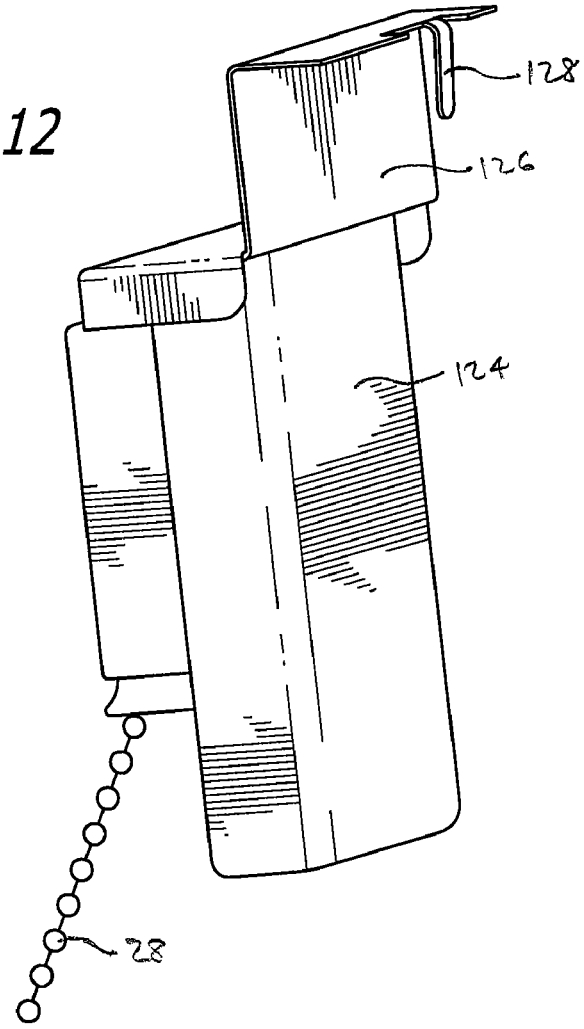
FIG. 12 is a side perspective view of a controlling element including a hanger section in the present invention.

A programming element 24 in the control system, as seen in FIGS. 1 and 4, enables programming of a controlling time, for controlling the duration and volume of flow of water in a flush of the toilet 12. The programming element 24 of the control system 10 is positionable at a user accessible location, such as on a lid 48 of the toilet 12.

The programming element 24 includes a microprocessor which is programmable for a time within the period of the minimum time required to complete a flush of the toilet 12 to the maximum time required to drain all of the water from a tank 50 of the toilet 12. The programming element 24 is programmable for two controlling times, constituting a small flush time and a large flush time. The small flush time comprises a controlling default flush time. The control system 10 is programmable to enable user actuation of the large flush time.

The programming element comprises a user interface module 24 which is programmable. The user interface module 24 includes a top cover 52, which may be transparent to enable elements therein to be visible. The top cover 52 may further include hinges 54 in the back, to enable opening and closing thereof, and a lock 56, which is extendible through a screw hole 58, to prevent tampering with flush time settings. The lock 56 may include the top cover 52 being able to snap in place, and a screw 60 for securing thereof. The user interface module 24 further includes a small flush control dial 62 for setting the small flush time, and a large flush control dial 64 for setting the large flush time, so the user can program the duration of the flush and the volume of water used per flush to the minimum amount the particular toilet 12 requires to complete a flush. As the small flush control dial 62 is turned clockwise, for example, the duration of the flush increases, which increases the amount of water used for the small flush. As the large flush control dial 64 is turned clockwise, for example, the duration of the flush increases, which increases the amount of water used for the large flush.

The user interface module 24 also includes a low battery light emitting diode 66, a flush light emitting diode 68, and a large flush select button 70. When the large flush select button 70 is pressed, for example, the user interface module 24 is notified that, if the toilet 12 is flushed in a time period such as the next ten seconds, a large flush is to be provided. The top cover 52 is able to be pressed to enable actuation of the large flush select button 70. The user interface module 24 further includes a printed circuit board, and a battery compartment 72 which includes a battery cover door and battery contacts 74. Rubber feet and tape may be included to prevent the user interface module 24 from moving or sliding from a location on top of the toilet tank 50. A cable 76, which extends from the user interface module 24 to the controlling element 26, comprises for example a flat ribbon cable, selected so that the toilet lid 48 can be closed without any elevation by the cable 76. A rubber grommet may be used to relieve strain to support the cable 76 at a location where it exits the user interface module 24, and to prevent moisture from entering therein.

The control system 10 further includes the controlling element 26, as seen in FIGS. 3, 5, and 8-12, which is connected to the programming element 24 and the non-buoyant flush valve 16. The controlling element 26 retains the non-buoyant flush valve 16 in the raised open position upon non-automated user actuation thereof to the raised open position, and releases the non-buoyant flush valve from the raised open position for closing the non-buoyant flush valve, within the controlling time.

The controlling element of the control system 10 comprises a control module 26, which is connected to the programming element 24 by the cable 76, and to the non-buoyant flush valve 16 by the control module connecting element 28. The control module 26 includes electro-mechanical elements.

The control module 26 retains the non-buoyant flush valve 16 in the raised open position upon non-automated user actuation of the non-buoyant flush valve 16 to the raised open position. It further releases the non-buoyant flush valve 16 from the raised open position for closing thereof. Retention and release of the non-buoyant flush valve 16 by the control module 26 are effected within the controlling time.

The control module 26 includes a spring cover 78, mounted on a spring cover shaft 80. It further includes a pulley 82, mounted on the spring cover shaft 80. A spring is covered by the spring cover 78, and is wound in a circular direction and anchored at two points. When the pulley 82 is rotated in one direction, the spring is wound up, creating a tension such that the spring seeks to turn in the opposite direction. This spring tension preloads the spring. When the control module connecting element 28 and the weighted element 30 locked thereto are pulled out, the preloaded spring gets wound increasingly tighter, such that the spring seeks to retract the control module connecting element 28 and the weighted element 30. The control module connecting element 28 is able to be retained in, and retracted to, wound condition on the pulley 82, and is able to be released from wound condition on the pulley 82.

The spring cover 78 has projections including teeth 84 projecting outwardly from the sides and spikes 86 extending upwardly from the top thereof. A ratchet pawl 88 and a ratchet pawl spring 90 are included in the control module 26. The ratchet pawl 88 includes an extending portion 92 and a depending portion 94. The ratchet pawl 88 is spring loaded by the ratchet pawl spring 90, so that the extending portion 92 is constantly being pulled toward the spring cover projecting teeth 84, and is biased by the ratchet pawl spring 90 into engagement with the spring cover projecting teeth 84.

The ratchet pawl extending portion 92, upon non-automated user actuation of the non-buoyant flush valve 16 to the raised open position, engages a spring cover projecting tooth 84, retaining the non-buoyant flush valve 16 in the raised open position. The spring cover projecting teeth 84 also enable rotation of the spring cover 78 and the pulley in the opposite direction, for enabling retraction of slack in the control module connecting element upon such non-automated user actuation thereof to the raised open position.

The ratchet pawl 88 is able to be pressed out of engagement with the spring cover projecting teeth 84, releasing the control module connecting element 28 and the non-buoyant flush valve 16 locked thereto by the weighted element 30. In the released condition of the non-buoyant flush valve 16, upon disengagement of the ratchet pawl extending portion 92 from a spring cover tooth 84, the spring cover 78 and the pulley 82 are able to rotate in a direction for releasing the control module connecting element 28 from retained and retracted condition on the pulley 82, and for releasing the non-buoyant flush valve 16 from the raised open position for closing the non-buoyant flush valve 16.

The control module 26 further includes a timing gear 96, which includes a cam portion 98 and an engageable teeth portion 100, and a timing gear spring 102. A motor 104 and a worm gear 106 are also included. Depending upon the direction in which the motor 104 turns the worm gear 106, as transmitted through the timing gear engageable teeth portion 100 to the timing gear 96, the timing gear cam portion 98 is either pressed against the ratchet pawl depending portion 94, or is directed away from the ratchet pawl 88. When pressed against the ratchet pawl depending portion 94, the timing gear 96 enables release of the non-buoyant flush valve 16 from the raised open position for closing the non-buoyant flush valve 16. When directed away from the ratchet pawl 88, the timing gear 96 enables retention of the non-buoyant flush valve 16 in the raised open position, and retention of the control module connecting element 28 in wound condition on the pulley 82.

The timing gear spring 102 maintains tension on the timing gear 96 to bias the timing gear 96 in the direction of the timing gear engageable teeth portion 100. The operation of the timing gear spring 102 allows the motor 104 to overrun without damaging the engageable teeth portion 100 of the worm gear 106. It also positions the timing gear 96 so that it is always in contact with the worm gear 106, so that when the motor 104 runs in the either direction, the engageable teeth portion 100 of the timing gear 96 are in contact with the worm gear 106.

Also, the control module 26 includes a movement detecting element, which comprises for example a piezo element 108, for detecting movement of the spring cover 78. The piezo element 108 is a crystal structure which creates an electric charge when a small amount of stress is applied, and which sends the electric charge to the programming element 24 to signal motion sensing. A piezo housing 110 houses the piezo element 108.

A piezo spring wire 112 and a piezo spring wire guide 114 are further included in the control module 26. The piezo spring wire 112 extends outwardly from the piezo element 108 inside the piezo housing 110, extends on top of the piezo spring wire guide 114, and is flicked by rotation of the spring cover extending spikes 86 as the spring cover 78 rotates. The piezo spring wire 112 transfers force received during the flicking thereof to the piezo element 108. When the piezo spring wire 112 is struck by the spring cover extending spikes 86, the piezo element 108 is stressed and sends an electric signal pulse for motion detection to the programming element 24. The piezo spring wire guide 114 directs the piezo spring wire 112 as it gets flicked by the rotating spring cover extending spikes 86.

Further, the control module 26 includes a cap 116, a housing 124, and a pulley housing cover 112. The components of the control module 26 are secured to the cap 116 which is inserted into the housing 124. A sealing ring creates a watertight seal when the cap 116 is secured to the housing 124. The pulley housing includes the cover 112 for the pulley 82, which includes an enlarged opening 122 for enabling the control module connecting element 28 to exit and enter therethrough in an unobstructed manner. The sealing ring creates a watertight seal around the housing 124 where the spring cover shaft 80 penetrates the housing 124.

The control module 26 further includes a bracket portion 126 which attaches to it. The housing bracket portion 126 includes a tab portion 128 which is able to securely retain the control module 26 on a rim 130 of the toilet tank 50. The bracket portion 126 is further bendable outwardly to extend over a thicker wall 132 of the toilet tank 50. The bracket portion 126 further includes a cutout to enable the tab portion 128 to be pulled outward for different thicknesses of the toilet tank wall 132. An opening in the bracket portion 126 enables exit and entry from under the bracket portion 126 for the cable 76 which connects the programming element 24 and the control module 26. The bracket portion opening is sealed after installation of the cable 76 to prevent water penetration.

In operation of the control system 10, in a small flush cycle, the user presses the toilet flush actuator 18 to flush the toilet 12. The non-buoyant flush valve 16 inside the toilet 12 rises, which opens the outlet of the toilet tank 50 and water is released into the toilet bowl. The control module connecting element 28 is connected to the weighted element 30, which is locked into place onto the non-buoyant flush valve 16 or the flush actuator connecting element 20. As the non-buoyant flush valve 16 begins to rise, so does the weighted element 30, and the control module connecting element 28 is retracted thereby. As the weighted element 30 rises, the control module connecting element 28 slackens, and this slack is refracted onto the pulley 82.

The rotation of the pulley 82, as it winds up the control module connecting element 28, actuates the piezo element 108. The piezo element 108 is actuated by the piezo spring wire 112 that is being flicked by the upwardly projecting spikes 86 on the top of the spring cover 78. The spring cover 78 is rotating by operation of the spring therein, which has been preloaded by the pulling out of the weighted element 30 when initially pulled out for attaching and locking onto the non-buoyant flush valve 16. The spring cover 78 is connected to the pulley 82 by the common spring cover shaft 80, causing the entire unit to rotate as a single assembly. The slack in the control module connecting element 28 causes the preloaded spring cover 78 to rotate, and thereby causes the pulley 82 to rotate and wind the control module connecting element 28 thereon.

The signal from the piezo element 108, actuated by rotation of the pulley 82, is received by the microprocessor in the user interface module 24. The signal from the piezo element 108 actuates the microprocessor to generate responsive operations in the control system 10. The flush light emitting diode 68 begins to flash. The small flush timer starts to function. The small flush timer consists of time values stored in the microprocessor. The time values for the small flush timer are preselected by the user by turning the small flush dial 62 on the user interface module 24 to program the duration of the small flush time. The motor 104 runs forward for approximately fifty milliseconds.

The ratchet pawl 88 is connected to the ratchet pawl spring 90, which is constantly pulling the ratchet pawl 88 in the direction of the outwardly projecting teeth 84 around the spring cover 78. When the timing gear 96 is no longer in contact with the ratchet pawl 88 due to the rotation of the motor 104, the ratchet pawl 88 moves into the engaged position, and locks the assembly of the spring cover 78 and the pulley 82 into the locked position. In the locked position, the spring cover 78 can continue to rotate in one direction but not the other. This allows the control module connecting element 28 to continue to be retracted as more slack is created. The control module connecting element 28 cannot be pulled back out, which would otherwise allow the weighted element 30 to be lowered and the non-buoyant flush valve 16 to be closed. When the ratchet pawl 88 is engaged with the spring cover 78, the non-buoyant flush valve 16 will be held in the open position, such that water will empty from the tank, and the non-buoyant flush valve 16 will not close until the ratchet pawl 88 is disengaged from the spring cover 78.

The microprocessor next waits for the flush timer to reach the small flush time. Upon the flush timer reaching the small flush time, the motor 104 runs in reverse for approximately fifty milliseconds, and rotates the timing gear 96 in the opposite direction, so that the timing gear 96 is fully pressing against the ratchet pawl 88. With the timing gear 96 pressing against the ratchet pawl 88, the ratchet pawl 88 is disengaged from the outwardly projecting teeth 84 of the spring cover 78, and the weighted element 30 is able to be lowered, which closes the non-buoyant flush valve 16 and stops the flush. Because the weighted element 30 counters buoyancy and the force of the spring in the spring cover 78, when the weighted element 30 is released from the locking engagement of the ratchet pawl 88 with the outwardly projecting teeth 84 of the spring cover 78, the weighted element 30 forces the non-buoyant flush valve 16 into the closed position.

Upon the flush timer reaching the end of the small flush time, the flush light emitting diode 68 stops flashing. At the end of the small flush cycle, all timers are reset. The toilet 12 then refills itself as it normally does.

In operation of the control system, in a large flush cycle, the user presses the large flush select button 70. The flush light emitting diode 68 begins flashing for ten seconds. The user has ten seconds to flush the toilet 12 if a large flush is desired, otherwise the system defaults to a small flush.

The user flushes the toilet 12 by pressing the toilet flush actuator 18. The non-buoyant flush valve 16 inside the toilet 12 rises, opening the outlet of the toilet tank 50, and water is released into the toilet bowl. The control module connecting element 28 is connected to the weighted element 30 which is locked onto the non-buoyant flush valve 16, such that, as the non-buoyant flush valve 16 begins to rise, so does the weighted element 30, and the control module connecting element 28 is retracted. As the weighted element 30 rises, the control module connecting element 28 slackens, and this slack is refracted onto the pulley 82. The rotation of the pulley 82, as it winds up the control module connecting element 28, actuates the piezo element 108.

The piezo element 108 is actuated by the piezo spring wire 112 which is flicked by the upwardly projecting spikes 86 of the spring cover 78. The spring cover 78 is rotating by operation of the spring inside the spring cover 78, which has been preloaded by the pulling out of the weighted element 30, when initially pulled out for attaching and locking onto the non-buoyant flush valve 16. The spring cover 78 is connected to the pulley 82 by the common spring cover shaft 80, causing the entire unit to rotate as a single assembly. The slack in the control module connecting element 28 causes the preloaded spring cover 78 to rotate, and thereby causes the pulley 82 to rotate and wind the control module connecting element 28 thereon.

The microprocessor in the user interface module 24 receives a signal from the piezo element 108. The signal from the piezo element 108 actuates the microprocessor to generate responsive operations in the control system 10. The flush light emitting diode 68 starts flashing. The microprocessor starts the large flush timer, which consists of the time values stored in the microprocessor which the user pre-selects by turning the large flush dial 64 on the user interface module 24 to program the duration of the large flush time. The motor 104 runs forward for approximately fifty milliseconds, and rotates the timing gear 96 so that the timing gear 96 is no longer pressing against the ratchet pawl 88.

The ratchet pawl 88 is connected to the ratchet paw spring 90, which is constantly pulling the ratchet pawl 88 in the direction of the outwardly projecting teeth 84 of the spring cover 78. When the timing gear 96 is no longer in contact with the ratchet pawl 88, due to rotation of the motor 104, the ratchet pawl 88 moves into the engaged position and locks the assembly of the spring cover 78 and the pulley 82 into the locked position.

In the locked position, the spring cover 78 can continue to rotate in one direction but not the other. This allows the control module connecting element 28 to continue to be retracted as more slack is created, while preventing the control module connecting element 28 from being pulled back out, which would otherwise allow the weighted element 30 to be lowered and the non-buoyant flush valve 16 to be closed. When the ratchet pawl 88 is engaged with the spring cover 78, the non-buoyant flush valve 16 will be held in the open position, so water will empty from the tank. The non-buoyant flush valve 16 will not close until the ratchet pawl 88 is disengaged from the spring cover 78.

The microprocessor in the user interface module 24 waits for the flush timer to reach the large flush time. When the flush timer reaches the large flush time, the motor 104 runs in reverse for approximately fifty milliseconds, and rotates the timing gear 96 in the opposite direction, such that the timing gear 96 is pressing against the ratchet pawl 88. With the timing gear 96 pressing against the ratchet pawl 88, the ratchet pawl 88 is disengaged from the outwardly projecting teeth 84 of the spring cover 78, and the weighted element 30 is able to be lowered, which closes the non-buoyant flush valve 16 and stops the flush. Because the weighted element 30 counters buoyancy and the force of the spring in the spring cover 78, when the weighted element 30 is released from the locking of the ratchet pawl 88, the weighted element 30 forces the non-buoyant flush valve 16 into the closed position.

Upon the flush timer reaching the end of the large flush time, the flush light emitting diode 68 stops flashing. At the end of the large flush cycle, all timers are reset. The toilet 12 then refills itself as it does normally.

Figure 13A:
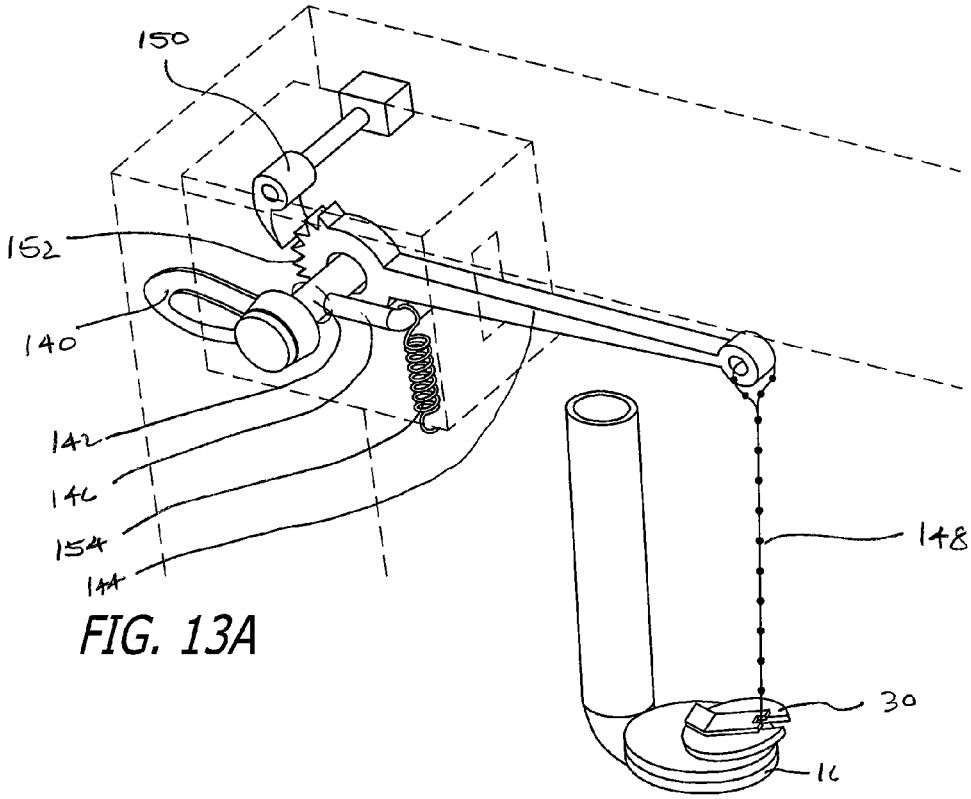
FIG. 13A is a perspective partly dashed-lines-housings view of a flush actuator and a control module in an embodiment of the present invention when the system is not flushing.
Figure 13B:
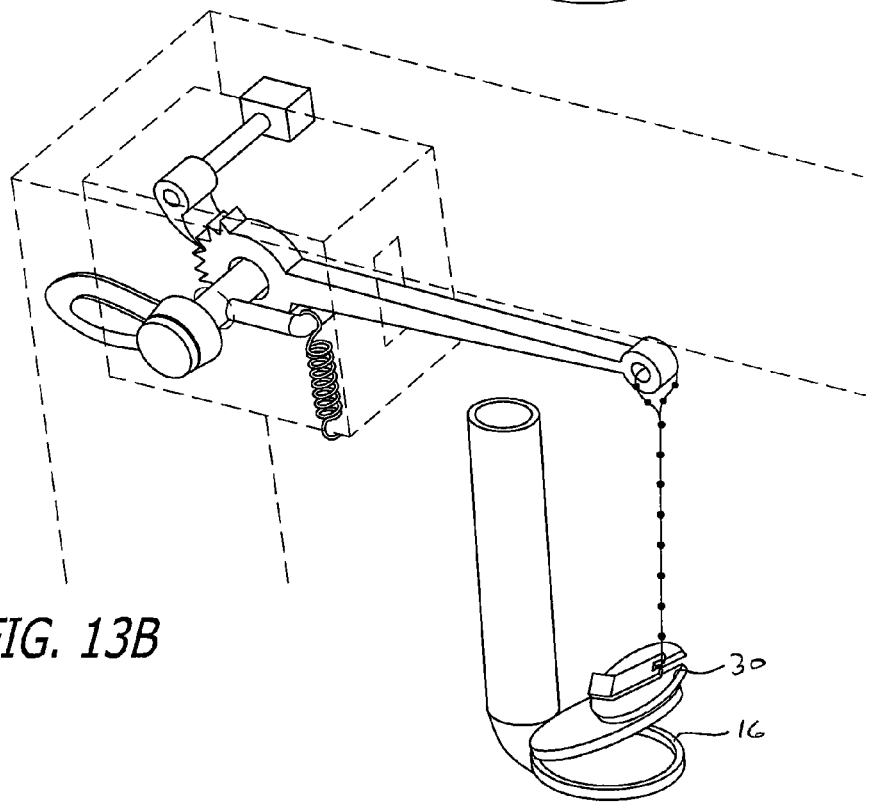
FIG. 13B is a perspective partly dashed-lines-housings view of a flush actuator and a control module in the embodiment in FIG. 13A of the present invention when the system is flushing.

In an embodiment of the invention, wherein the control system 10 includes a single connecting element 148 for the flush actuator and the controlling element, as seen in FIGS. 13A and 13B, the control module 26 further includes the flush actuator 18, and the flush actuator 18 and the connecting element 148 enable user actuation of the flush actuator 18 to generate non-automated user actuation of the non-buoyant flush valve 16 to the raised open position. In such embodiment, the flush actuator 18 and the connecting element 148 enable the control module 26 to retain the non-buoyant flush valve 16 in the raised open position upon non-automated user actuation of the non-buoyant flush valve 16 to the raised open position. They further enable the control module 26 to release the non-buoyant flush valve 16 from the raised open position for closing the non-buoyant flush valve 16, within the controlling time.

Figure 17:
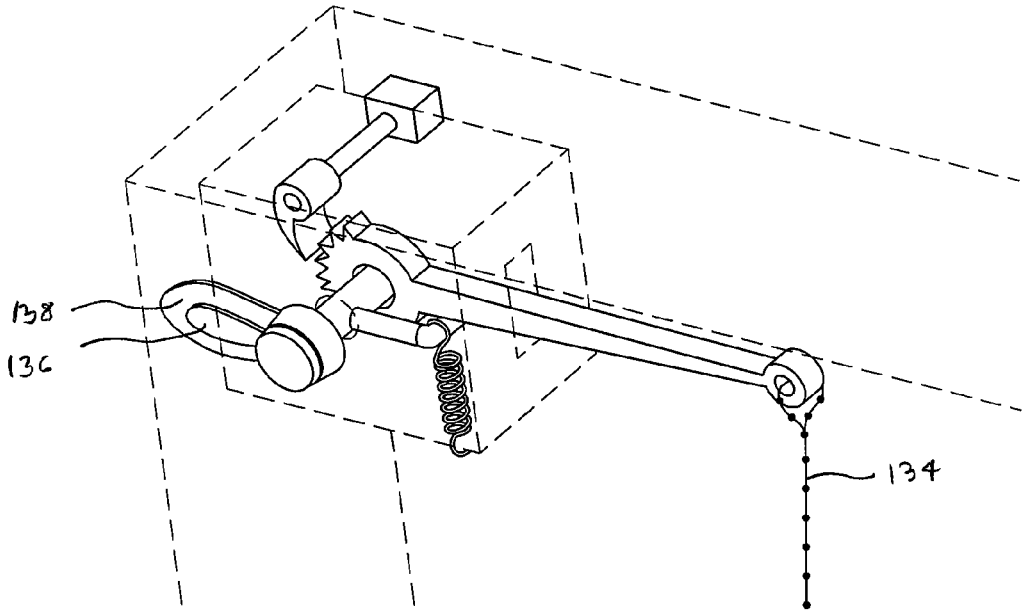
FIG. 17 is a perspective partly dashed-lines-housings view of a dual handle flush actuator and a control module in an embodiment of the present invention when the system is not flushing.

In another embodiment of the invention, in FIG. 17, the user interface module 24 is programmable for a controlling time which comprises a small flush time comprising a controlling default flush time, the flush actuator 18 includes a small flush handle 136, and user actuation of the small flush handle 136 generates non-automated user actuation of the non-buoyant flush valve 16 to the raised open position. The user interface module 24 is further programmable for a further controlling time which comprises a large flush time, the flush actuator 18 further includes a large flush handle 138, which is engageable with the small flush handle 136. Initial user movement of the large flush handle 138 generates actuation of the large flush time, and further user movement of the large flush handle 138 into engagement with the small flush handle 136 generates non-automated user actuation of the non-buoyant flush valve 16 to the raised open position.

In a further embodiment of the invention, as seen in FIGS. 13A and 13B, the flush handle 140 is mounted on a toilet tank 50, with a shaft 142 fixed to the flush handle 140 and penetrating the toilet tank 50 as well as a control module 26. A flush lever 144 pivots on the flush handle shaft 142 and is prevented from rotating clockwise relative to the flush handle 140 by a finger 146 which is fixed to the flush handle shaft 142. When the flush handle 140 is pushed by the user and thereby rotated counterclockwise, the flush lever 144 will also rotate counterclockwise. This raises a chain 148, which connects to a non-buoyant flush valve, and flushes the toilet 12. A ratchet pawl 150 can be selectively engaged to teeth 152 which are fixed to the flush lever 144. As the flush lever 144 rotates counterclockwise, the movement of the flush lever 144 is detected by a sensor which detects movement of the flush handle 140, such detection signaling ratchet pawl control means to engage the ratchet pawl 150 to prevent subsequent clockwise movement of the flush lever 144. This maintains the open state of the non-buoyant flush valve until the flush timer completes its cycle. When the ratchet pawl 150 is holding the flush lever 144, the flush handle 140 is free to move back to its starting position. A spring 154 is connected to the finger 146 to accomplish this. When the timed flush cycle is complete, the ratchet pawl control means act to release the ratchet pawl 150 from engagement with the teeth 152, thereby dropping the chain 148, which closes the non-buoyant flush valve and stops the flush.

Figure 14A:
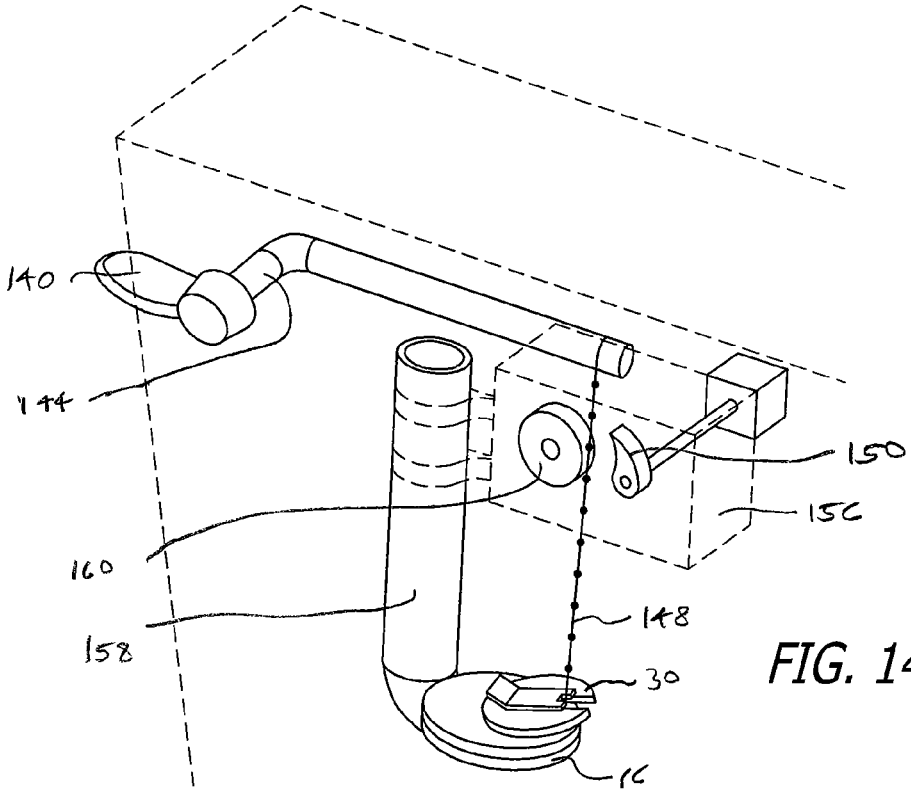
FIG. 14A is a perspective partly dashed-lines-housings view of a flush actuator and a control module in another embodiment of the present invention when the system is not flushing.
Figure 14B:
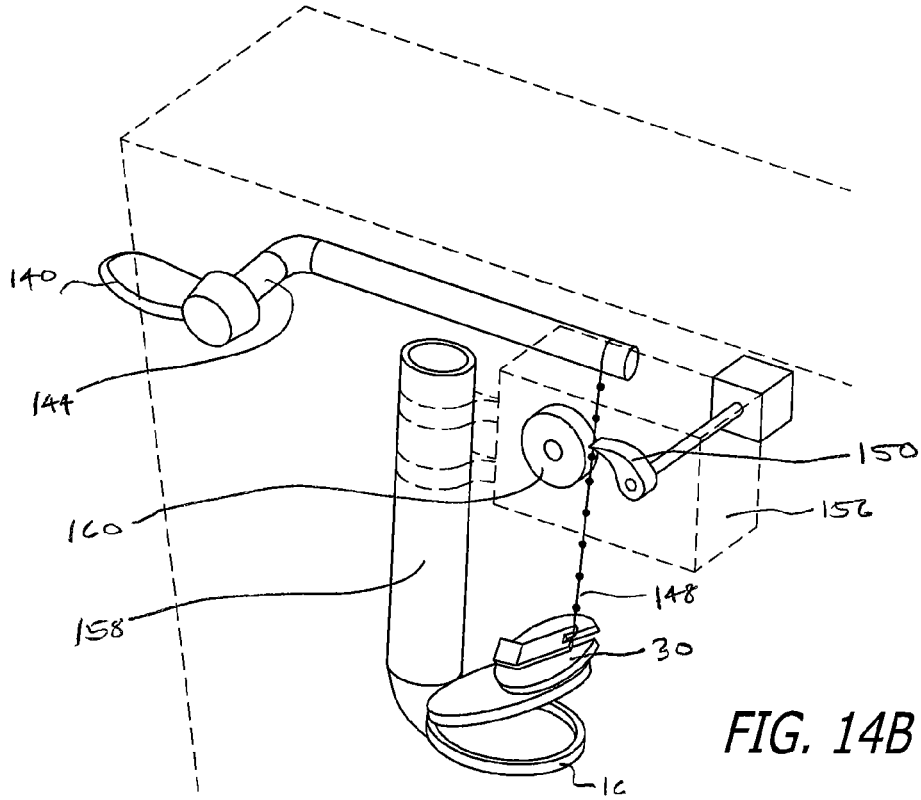
FIG. 14B is a perspective partly dashed-lines-housings view of a flush actuator and a control module in the embodiment in FIG. 14A of the present invention when the system is flushing.

Further, in an embodiment of the invention in FIGS. 14A and 14B, the flush handle 140 is mounted on a toilet tank 50. A flush lever 144 is connected to the chain 148, which connects to a non-buoyant flush valve 16, to allow the user to flush the toilet 12. A mechanism housing 156 is mounted to an overflow tube 158. The chain 148 is enveloped by the housing 156, and passes between a wheel 160 and the ratchet pawl 150. The ratchet pawl 150 can be selectively engaged to the chain 148. The ratchet pawl 150 in FIG. 14A is in a disengaged position, and is in an engaged position in FIG. 14B. When the flush handle 140 is depressed by the user, the movement of the chain 148 is detected by a sensor which detects movement of the flush handle 140, such detection signaling the ratchet pawl control means to move the ratchet pawl 150 to the engaged state wherein it grips the chain 148, thereby pinching it against the wheel 160 and preventing the chain 148 from moving down. Since the non-buoyant flush valve 16 is connected to the chain 148, this maintains the open state of the non-buoyant flush valve 16 until a flush timer completes its cycle. When the timed flush cycle is complete, the ratchet pawl control means acts to release the ratchet pawl 150 from engagement with the chain 148, thereby dropping the chain 148, which closes the non-buoyant flush valve 16 and stops the flush.

Figure 15A:
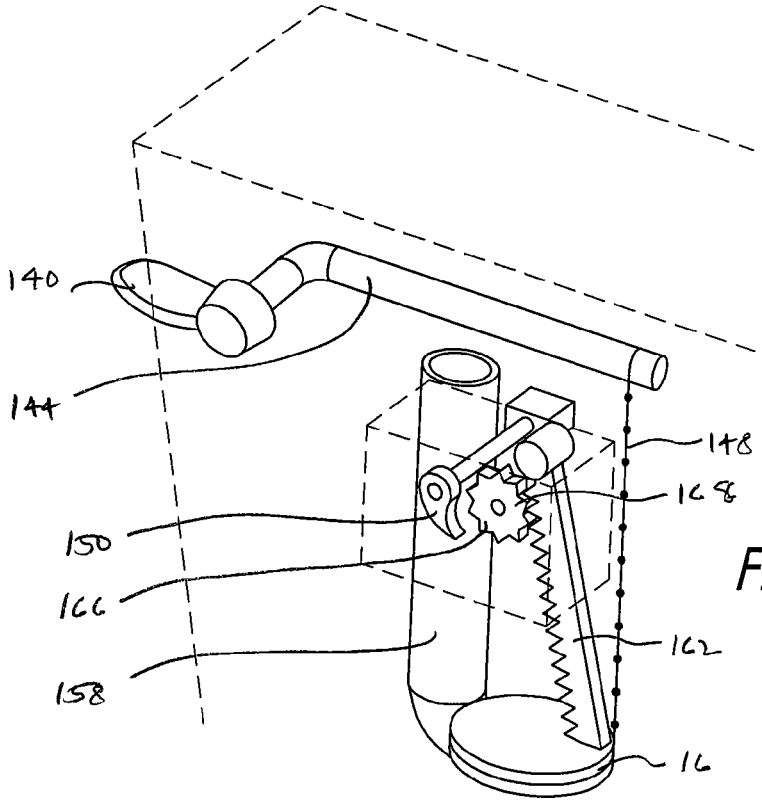
FIG. 15A is a perspective partly dashed-lines-housings view of a flush actuator and a control module in a further embodiment of the present invention when the system is not flushing.
Figure 15B:
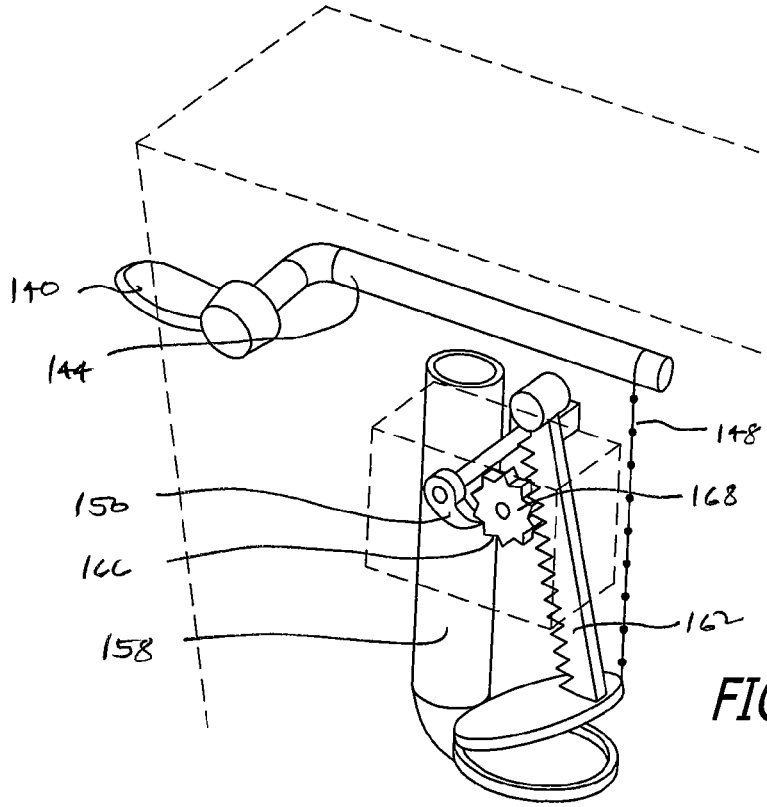
FIG. 15B is a perspective partly dashed-lines-housings view of a flush actuator and a control module in the embodiment in FIG. 15A of the present invention when the system is flushing.

In still another embodiment of the invention, as shown in FIGS. 15A and 15B, a flush handle 140 is mounted on a toilet tank 50. A flush lever 144 is connected to a chain 148, which connects to a flush valve 14 to allow the user to flush the toilet 12. The bottom end of a rack 162 is connected to the chain 148 near the end thereof that connects to the flush valve 14. The rack 162 has enough weight that it will counter any buoyancy that the flush valve 14 may have. Teeth 164 on the rack 162 engage teeth 166 on a gear 168. A ratchet pawl 150 can be selectively engaged to the gear 168. FIG. 15A shows the ratchet pawl 150 in a disengaged position, and FIG. 15B shows the ratchet pawl 150 in the engaged position. When the flush handle 140 is depressed by the user, the movement of the gear 168 is detected by a sensor which detects movement of the flush handle 140, such detection signaling a ratchet pawl control means to move the ratchet pawl 150 to the engaged state, wherein it grips the gear 168, thereby preventing it from rotating clockwise, which in turn prevents the rack 162 from moving down. Since the flush valve 14 is connected to the rack 162 by the chain 148, this maintains the open state of the flush valve 14 until the timer completes its flush cycle. When the timed flush cycle is complete, the ratchet pawl control means act to release the ratchet pawl 150 from engagement with the gear 168, thereby dropping the rack 162 which closes the flush valve 14 and stops the flush.

In a variation of the embodiment, the ratchet pawl is not present, and the rack 162 is very light in weight instead of heavy. In this variation, the gear 168 is driven by a motor. When a user initiates a flush action by pushing the flush handle 140, this causes the chain 148 to rise, which lifts the flush valve 14 and the rack 162. The rack 162 rises and drives the gear 168. The motor connected to the gear 168 is not energized, and does not prevent the rotation of the gear 168. The rotation of the gear 168 is detected by the sensor and the timed flush cycle starts. When the timed flush cycle completes, the motor is energized such that it drives the gear 168 clockwise which forces the rack 162 down, closes the flush valve 14, and ends the flush.

Figure 16A:
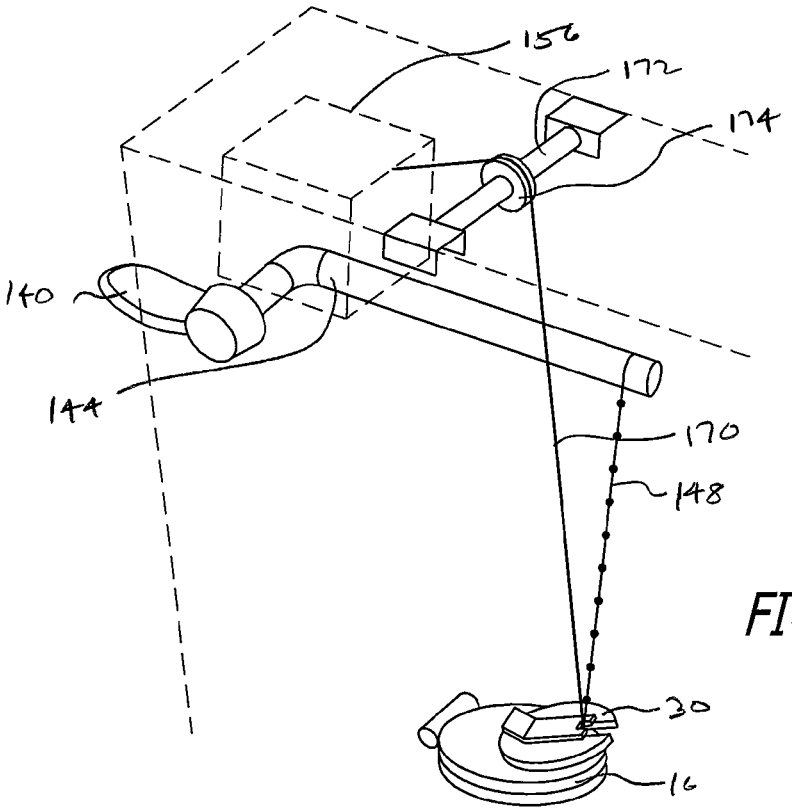
FIG. 16A is a perspective partly dashed-lines-housings view of a flush actuator and a control module in a still further embodiment of the present invention when the system is not flushing.
Figure 16B:
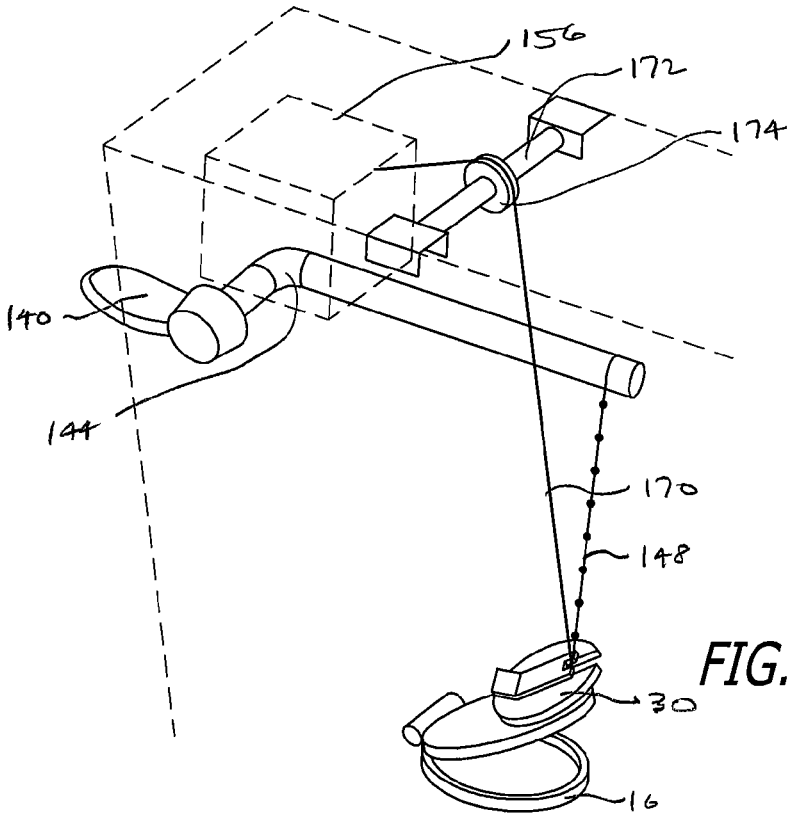
FIG. 16B is a perspective partly dashed-lines-housings view of a flush actuator and a control module in the embodiment in FIG. 16A of the present invention when the system is flushing.

Also, in another embodiment of the invention, in FIGS. 16A and 16B, a flush handle 140 is mounted to a toilet tank 12. A flush lever 144 is connected to a chain 148, which connects to a non-buoyant flush valve 16 to allow the user to flush the toilet 12. A weighted element is provided to convert a flush valve into a non-buoyant flush valve 16. A mechanism housing 156 is mounted near the flush handle 140, and may be connected to the flush lever 144 or to a hole in the toilet tank 50 which may be provided for the flush lever 144. A cable 170 is connected to the chain 148 near the end thereof which connects to the non-buoyant flush valve 16. A bracket 172 is supported at its ends on a top rim 130 of the toilet tank 12, and provides a rotatable mounting location for a pulley 174. The pulley 174 is located such that it can redirect the line of operation of the cable 170 from its origin at the mechanism housing 156 down to a terminus at the non-buoyant flush valve 16. When the flush handle 140 is depressed by the user, the movement of the chain 148 causes the cable 170 to move, which is detected by a sensor which detects movement of the flush handle 140, and the mechanism housing 156 operates to hold the non-buoyant flush valve 16 open for a timed flush cycle.

In a variation of the embodiment, the flush select button 70 to select the flush size is connected to the mechanism housing 156 but is located outside and in front of the toilet tank 12, near the location of the flush handle 140. In another variation of the embodiment, the flush select button 170 is integrated into the flush handle 140, or takes the form of a secondary flush handle.

Figure 20:
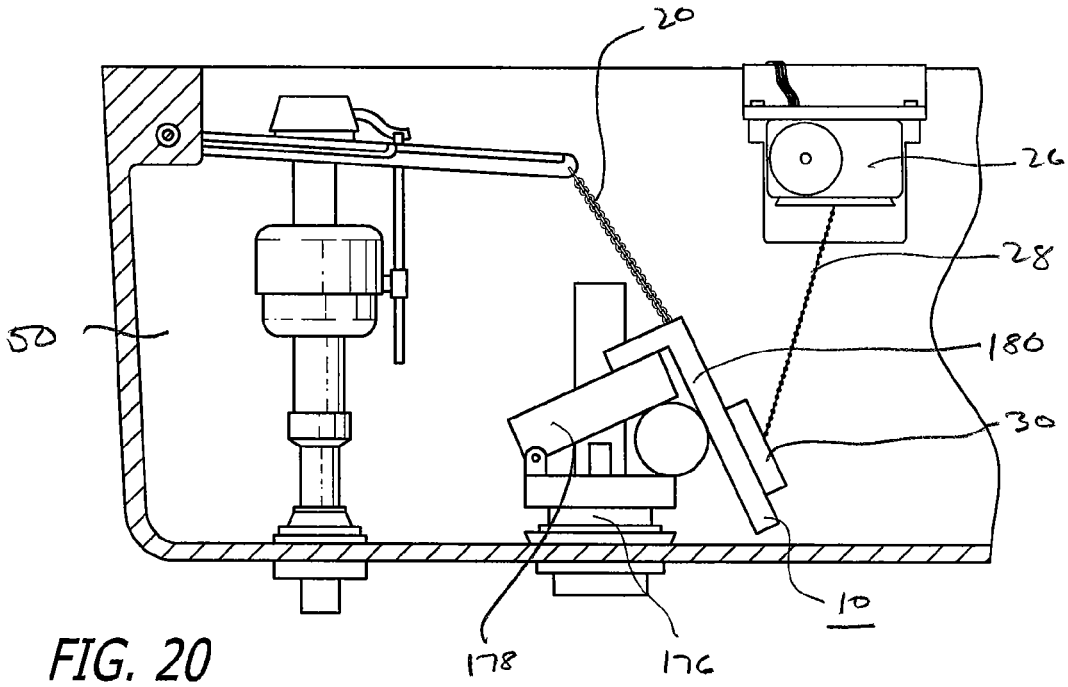
FIG. 20 is cutaway side elevational partly fragmentary view of a toilet which includes a controlling system and a converting element of the present invention for an Actuator type flush valve system.

In a further embodiment of the invention, in an Actuator type flush valve system, as seen in FIG. 20, the actuator flush valve 176 includes an actuator 178, and the control system 10 includes an actuator adapter 180, which is secured to the actuator 178. The control system 10 further includes a weighted element 30, which is secured to the actuator adapter 180, and to which the control module connecting element 28 is clamped. The weighted element 30 is positioned in the section of the actuator adapter 180 distant from, and in front of, the actuator 178, which enables the control system 10 to counter and overcome the force of buoyancy of the actuator flush valve 176. The actuator adapter 178 includes a thumb screw, which locks the actuator adapter 180 to the flush actuator connecting element 20 for connecting to the actuator 178. By locking the actuator adapter 180 to the actuator flush actuator connecting element 20, the actuator adapter 180 is securely locked to the actuator 178.

In a still further embodiment of the invention, in FIG. 19, in a Lift Wire type flush valve system, the weighted element 30 is able to receive a lift wire 182 in the main channel 38 thereof, and the spring-loaded tab of the weighted element 30 pinches onto the lift wire 182.

A Mansfield or Tower type flush valve system is accommodated in another embodiment of the invention, as seen in FIG. 18, the weighted element 30 is able to receive a cable tie 184 through its plastic loops, so the cable tie 184 can then wrap around a tower valve to securely attach the weighted element 30 to it.

In a further embodiment of the invention, in FIG. 4A, a sensing element 176 associated with the user interface module 24 may be programmed to sense the presence of a person and the length of time the person has been using the toilet 12, and for automatically determining whether to provide a small flush time or a large flush time. The sensing element 176 further includes a time threshold determining element 178 for enabling the user to program a time threshold for the sensing element to determine the type of flush to provide. The bathroom habits of the average person require greater than one minute at the toilet 12 for a bowel movement.

In such embodiment, if the time threshold determining element is programmed at one minute and a user is detected at the toilet 12 for longer than one minute, the user interface module 24 will run the large flush cycle upon the detection of a flush of the toilet 12. If a user is not detected at the toilet 12 for more than one minute, a small flush cycle will be provided upon the detection of a flush of the toilet 12. The sensing element enables the user to use the flush toilet, without modifying toilet flushing habits, such that the large flush select button 70 need not be pressed prior to flushing the toilet 12 when a large flush is desired. Further, the user need not to be taught how to use the device, since there would be no change in operation of the toilet 12 and no user interface with the device.

In the sensing element embodiment, the sensing element may be located on the user interface module 24 so that it can be pointed in a direct line of sight at a person sitting on the toilet. The user interface module 24 would include a time threshold dial to enable the user to adjust the setting, for example, by turning the time threshold dial clockwise to increase the amount of time that the sensing element 176 requires to detect a user at the toilet 12 before the time threshold is met. Once the time threshold is met by a user being detected at the toilet 12, then the user interface module 24 would provide the next flush as a large flush. The large flush select button 70 can still be used in conjunction with the sensing element 186. If the large flush select button 70 is pressed at any time, for example, a large flush will be provided if the toilet 12 is flushed within ten seconds of the large flush select button 70 being pressed.

While the particular water flow controlling system as shown and disclosed in detail herein is fully capable of obtaining the objects and providing the advantages previously stated, it is to be understood that it is merely illustrative of the presently preferred embodiment of the invention, and that no limitations are intended to the details of construction or design shown herein other than as described in the appended claims.

I claim:

1. A system for programmably controlling the duration and volume of a flow of water in a flush of a toilet, wherein the toilet includes a flush actuator of the type having a mechanism mounted to an exterior wall of the toilet tank that penetrates through the tank wall to extend inside the tank and connect to a buoyant flush valve within the tank, wherein pressure actuation of the flush actuator by a user moves the flush actuator mechanism to raise the buoyant flush valve to open a flush aperture for the toilet tank, wherein the improvement comprises:

a converting element, for converting the buoyant flush valve to a non-buoyant flush valve which upon user actuation of the flush actuator raises the converted non-buoyant flush valve to a raised open position, and which enables control of the operation of the flush valve such that the duration of the flush no longer depends on the flush valve losing buoyancy in order to close;

a programming element, for enabling programming of at least a small flush controlling time and a large flush controlling time, for controlling the duration and volume of water passing beneath the flush valve via gravity force, thus controlling the duration and volume of flow of water in a flush of a toilet; and a controlling element, connected to the programming element and the non-buoyant flush valve, responsive to movement of the flush actuator mechanism for retaining the non-buoyant flush valve in the raised open position upon user actuation of the flush actuator, and for releasing the non-buoyant flush valve from the raised open position for closing the non-buoyant flush valve, within a selected one of the small flush controlling time and the large flush controlling time.

2. A system as in claim 1, wherein the converting element, programming element, and controlling element are provided to be retrofittable in a standard toilet tank with a standard toilet tank lid.

3. A system as in claim 1, wherein the programming element is programmable for a controlling time within the period of a minimum time required to complete a small flush of a partial amount of the water in the toilet to a maximum time required to drain all of the water from within a toilet tank.

4. A system as in claim 1, wherein the programming element is programmable for two controlling times.

5. A system as in claim 1, wherein the programming element is positionable at a user-accessible location.

6. A system as in claim 1, wherein the programming element comprises a user interface module.

7. A system as in claim 1, wherein the controlling element includes a connecting element, connected at one end to the controlling element and at the other end to the non-buoyant flush valve.

8. A system as in claim 6, wherein the programming element of the system is programmable to enable user actuation of the small flush time.

9. A system as in claim 6, wherein the programming element of the system is programmable to enable user actuation of the large flush time.

10. A system as in claim 6, wherein the user interface module includes a sensing element, for sensing the presence of a person and the length of time the person has been using the toilet, and for automatically determining whether to provide a small flush time or a large flush time based on the length of time of use.

11. A system as in claim 10, wherein the sensing element further includes a time threshold determining element for enabling the user to program a time threshold for the sensing element to determine the type of flush to provide.

12. A system for programmably controlling the duration and volume of a flow of water in a flush of a toilet, wherein the toilet includes a flush actuator which is connected to a buoyant flush valve which is non-automated in user actuation thereof to a raised open position, wherein the improvement comprises:

a converting element, for converting the buoyant flush valve to a non-buoyant flush valve which upon user actuation of the flush actuator generates is non-automated user actuation of the non-buoyant flush valve to a raised open position, and which enables control of the operation of the flush valve such that the duration of the flush no longer depends on the flush valve losing buoyancy in order to close;

a programming element, for enabling programming of at least a small flush controlling time and a large flush controlling time, for controlling the duration and volume of water passing beneath the flush valve via gravity force, thus controlling the duration and volume of flow of water in a flush of a toilet; and a controlling element, connected to the programming element and the non-buoyant flush valve, for retaining the non-buoyant flush valve in the raised open position upon user actuation of the flush actuator via non-automated user actuation thereof to the raised open position, and for releasing the non-buoyant flush valve from the raised open position for closing the non-buoyant flush valve, within a selected one of the small flush controlling time and the large flush controlling time, wherein the controlling element includes a connecting element, connected at one end to the controlling element and at the other end to the non-buoyant flush valve, wherein the connecting element is a chain, string, strap or wire wound on a spring-loaded pulley at one end to the controlling element and at the other end to the non-buoyant flush valve, and wherein the spring-loaded pulley is wound in one direction by pulling out the connecting element and creating a spring tension on the connecting element, and when the connecting element is released from pulling out employs the spring tension to retract the connecting element, a ratchet pawl engageable with the pulley such that in a disengaged position the pulley can rotate in either direction so that the non-buoyant flush valve can be closed, and in an engaged position the pulley can rotate in one direction but not the other to allow for retracting the connecting element by spring force and preventing rotation in the opposite direction for holding the pulley in a retraction position so that the non-buoyant flush valve can be held in the raised open position, and a motor which when actuated in one direction by a control signal from the programming element, moves the ratchet pawl to the engaged position so that the non-buoyant flush valve is held in the raised open position, and when actuated in the other direction, moves the ratchet pawl to release the pulley and enable the connecting element to be pulled out via gravity force for closing the non-buoyant flush valve.

13. A system as in claim 12, wherein the control module includes a motion detecting element for detecting motion of the pulley and sending an electric signal for the pulley motion to the programming element to generate responsive operations.

* * * * *